US006204440B1

(12) United States Patent
Yu

(10) Patent No.: US 6,204,440 B1
(45) Date of Patent: Mar. 20, 2001

(54) GUITAR HOLDER DEVICE

(76) Inventor: Ming-Ti Yu, 122-5, Jun Liao Road, Feng Yuan, Taichung Hsien (TW)

( * ) Notice: Subject to any disclaimer, the term of this patent is extended or adjusted under 35 U.S.C. 154(b) by 0 days.

(21) Appl. No.: 09/073,974

(22) Filed: May 7, 1998

(51) Int. Cl.[7] ..... G10D 3/00

(52) U.S. Cl. ..... 84/327; 84/329; 84/421; 248/220.41; 403/93

(58) Field of Search ..... 84/327, 421, 329, 84/453; 248/220.41, 220.31, 222.51, 289.11, 292.12; 403/93, 94, 96

(56) References Cited

U.S. PATENT DOCUMENTS 4,182,505 * 1/1980 Cobin ..... 248/220.41

5,346,168 * 9/1994 Astrella ..... 248/278.1

* cited by examiner

*Primary Examiner*—Shih-Yung Hsieh

(57) ABSTRACT

A guitar holder device has a U-shaped hanger, an L-shaped rod disposed on the U-shaped hanger, a holder joint disposed on an end of the L-shaped rod, a disk inserted in the holder joint pivotally, and a U-shaped bar connected to the disk. A bolt fastens the disk in the holder joint. The holder joint has a U-shaped main body, a positioning through hole formed on the U-shaped main body, an oblong through hole formed on the U-shaped main body, a rivet passing through the oblong through hole and a washer, and a bolt passing through the positioning through hole, the disk, and a nut.

3 Claims, 4 Drawing Sheets

GUITAR HOLDER DEVICE

BACKGROUND OF THE INVENTION

The present invention relates to a guitar holder device. More particularly, the present invention relates to a guitar holder device which can be hung on a rack.

A conventional guitar holder device can hold a guitar at a fixed angle only. However, the guitar cannot be rotated to a predetermined angle.

SUMMARY OF THE INVENTION

An object of the present invention is to provide a guitar holder device which can be hung on a rack.

Another object of the present invention is to provide a guitar holder device which has a disk to be rotated to any predetermined angle.

Accordingly, a guitar holder device comprises a U-shaped hanger, an L-shaped rod disposed on the U-shaped hanger, a holder joint disposed on an end of the L-shaped rod, a disk inserted in the holder joint pivotally, and a U-shaped bar connected to the disk. The disk has a center hole, a semicircular groove, and a plurality of notches. Two annular cushions are disposed on an upper face of the disk and a lower face of the disk. A block plate and an elastic block are disposed between the disk and the holder joint. The block plate engages with the disk. The holder joint comprises a U-shaped main body, a positioning through hole formed on the U-shaped main body, an oblong through hole formed on the U-shaped main body, a rivet passing through the oblong through hole and a washer, and a bolt passing through the positioning through hole, the center hole, the annular cushions, and a nut.

DETAILED DESCRIPTION OF THE INVENTION

Figure 1:
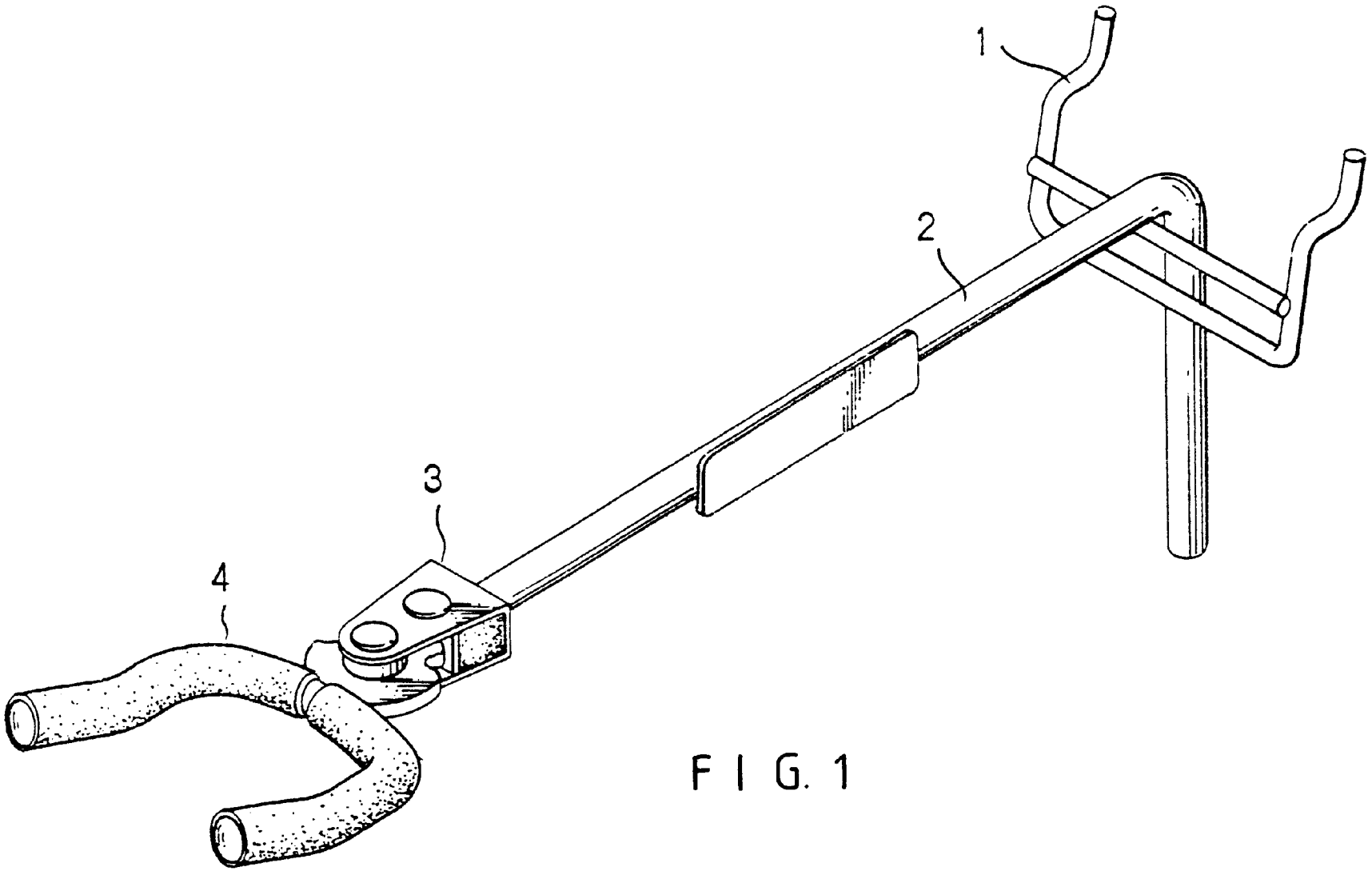
FIG. 1 is a perspective assembly view of a guitar holder device of a preferred embodiment in accordance with the present invention.
Figure 2:
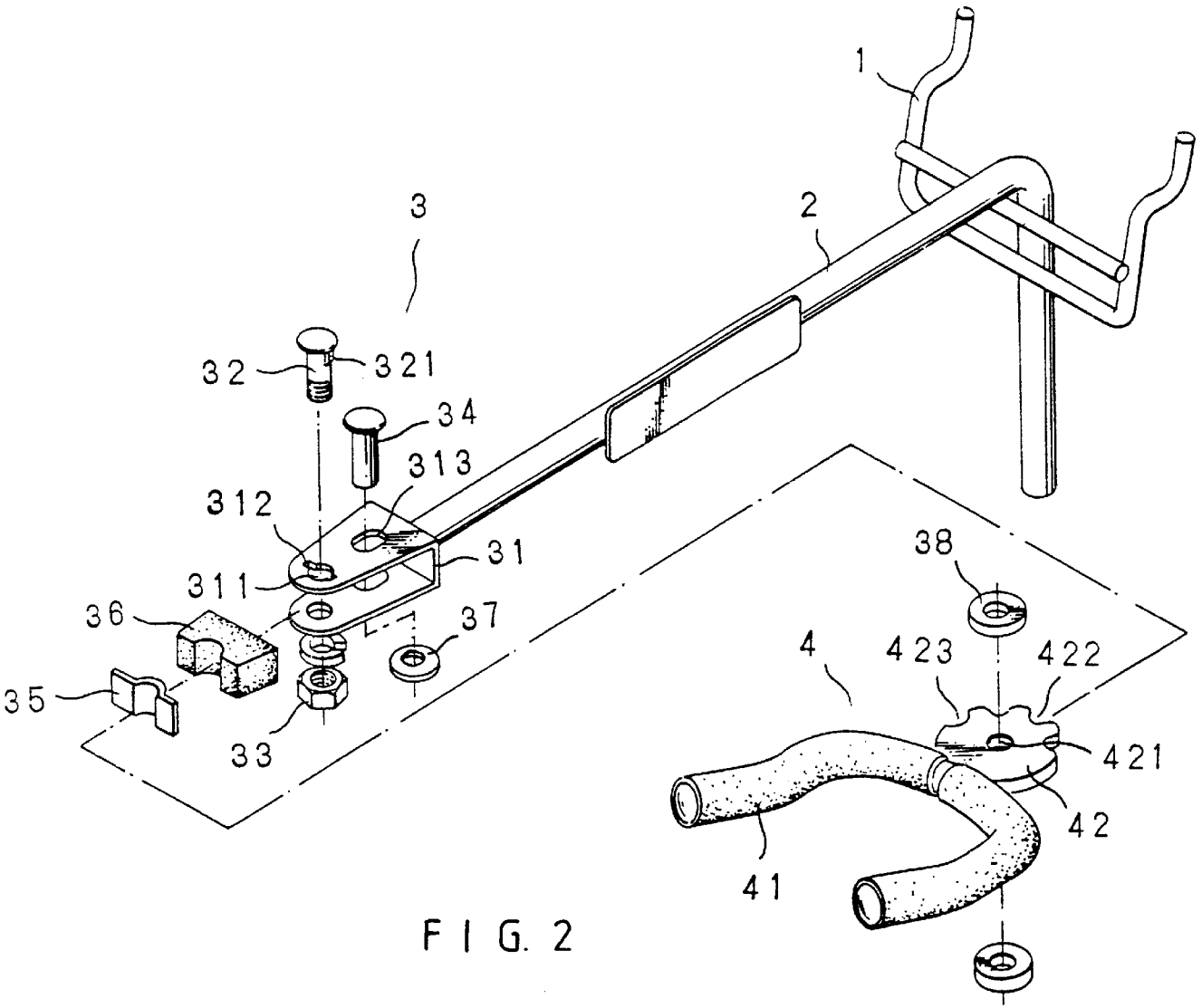
FIG. 2 is a perspective exploded view of a guitar holder device of a preferred embodiment in accordance with the present invention.
Figure 3:
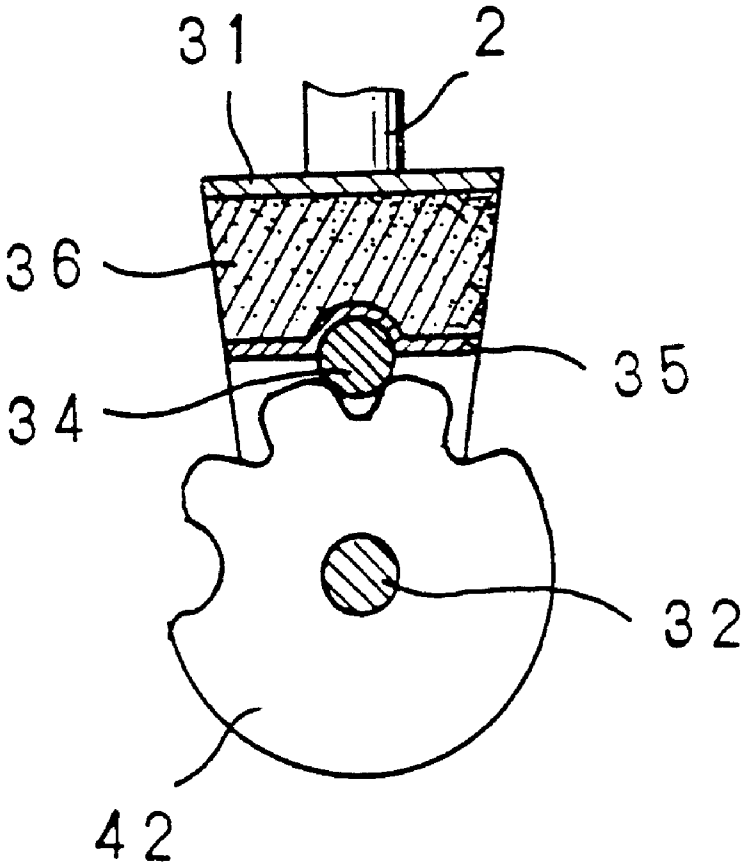
FIG. 3 is a sectional view of a holder joint.

Referring to FIGS. 1 to 3, a guitar holder device comprises a U-shaped hanger 1, an L-shaped rod 2 disposed on the U-shaped hanger 1, a holder joint 3 disposed on an end of the L-shaped rod 2, a disk 42 inserted in the holder joint

3 pivotally, and a U-shaped bar 4 connected to the disk 42. The U-shaped bar 4 has two arms 41.

The disk 42 has a center hole 421, a semicircular groove 423, and a plurality of notches 422. Two annular cushions 38 are disposed on an upper face of the disk 42 and a lower face of the disk 42.

A block plate 35 and an elastic block 36 are disposed between the disk 42 and the holder joint 3. The block plate 35 engages with the disk 42.

The holder joint 3 comprises a U-shaped main body 31, a positioning through hole 311 formed on the U-shaped main body 31, a slot 312 formed on the U-shaped main body 31 communicating with the positioning through hole 311, an oblong through hole 313 formed on the U-shaped main body 31, a rivet 34 passing through the oblong through hole 313 and a washer 37, and a bolt 32 passing through the positioning through hole 311, the center hole 421, the annular cushions 38, and a nut 33.

The U-shaped hanger 1 and the L-shaped rod 2 are soldered together.

The bolt 32 has a protrusion 321.

The elastic block 36 is made of an elastic material such as a rubber, a resin and a plastics.

The semicircular groove 423 can receive the rivet 34. The disk 42 can be rotated.

Figure 4:
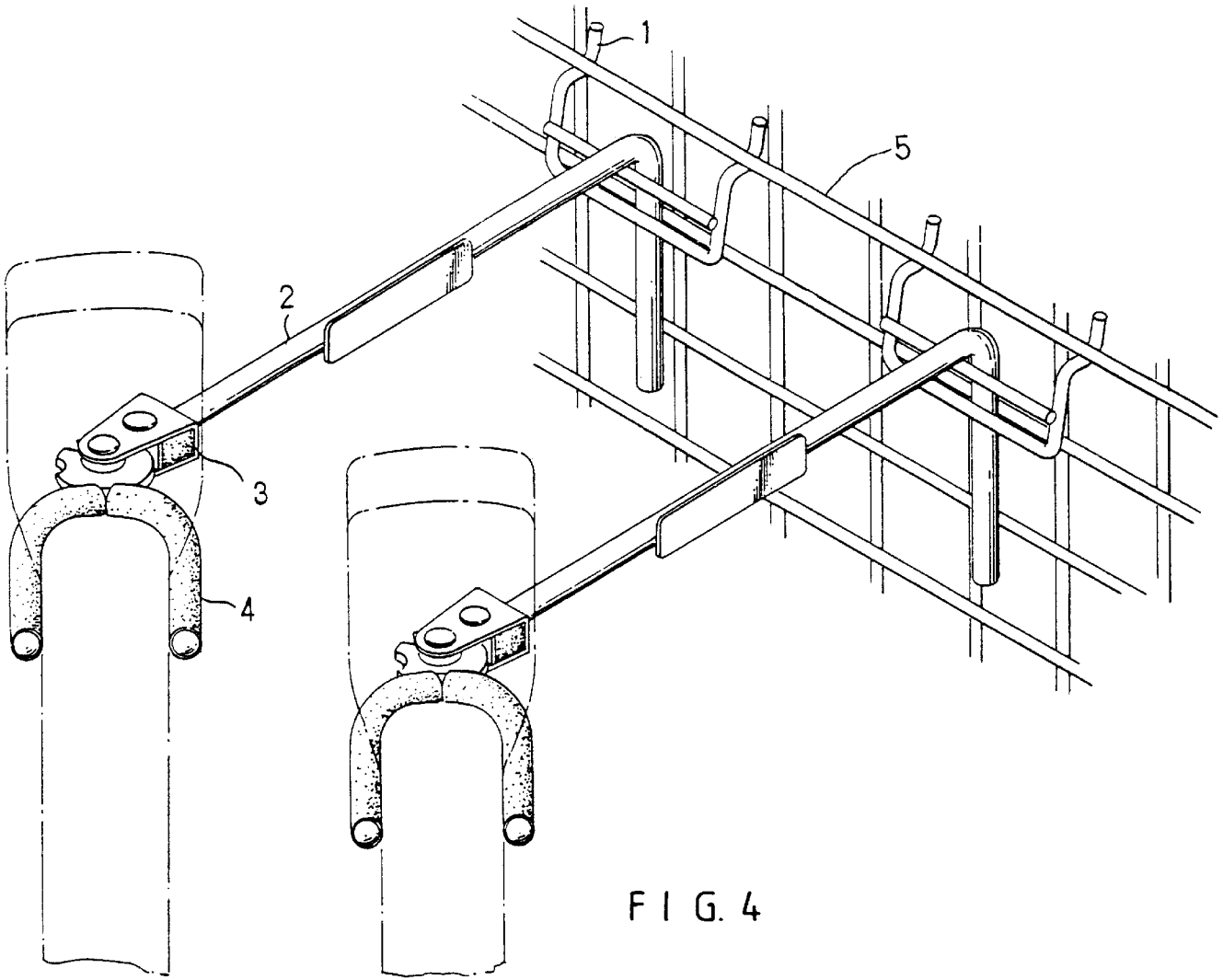
FIG. 4 is a schematic view illustrating an application of a guitar holder device of a preferred embodiment in accordance with the present invention.

Referring to FIG. 4, the guitar holder device can be hung on a rack 5 which is positioned on a wall. The U-shaped hanger 1 engages with the rack 5. The U-shaped bar 4 holds a guitar.

The present invention is not limited to the above embodiment but various modification thereof may be made. Furthermore, various changes in form and detail may be made without departing from the scope of the present invention.

I claim:

1. A guitar holder device comprises:

a U-shaped hanger, an L-shaped rod disposed on the U-shaped hanger, a holder joint disposed on an end of the L-shaped rod, a disk inserted in the holder joint pivotally, and a U-shaped bar connected to the disk.

2. A guitar holder device as claimed in claim 1, wherein the disk has a center hole, a semicircular groove, and a plurality of notches.

3. A guitar holder device as claimed in claim 2, wherein the holder joint comprises a U-shaped main body, a positioning through hole formed on the U-shaped main body, an oblong through hole formed on the U-shaped main body, a rivet passing through the oblong through hole and a washer, and a bolt passing through the positioning through hole, the center hole, two annular cushions, and a nut.

* * * * *